US011027894B2

(12) United States Patent
Tomasiak et al.

(10) Patent No.: US 11,027,894 B2
(45) Date of Patent: Jun. 8, 2021

(54) VACUUM CLEANER INCLUDING COMBINED HANDLE AND LID LATCH SYSTEM AND METHODS OF ASSEMBLING SAME

(71) Applicant: Emerson Electric Co., St. Louis, MO (US)

(72) Inventors: Mark J. Tomasiak, St. Peters, MO (US); Alex J. Wall, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 657 days.

(21) Appl. No.: 15/965,334

(22) Filed: Apr. 27, 2018

(65) Prior Publication Data

US 2019/0329940 A1 Oct. 31, 2019

(51) Int. Cl.

| | |
|---|---|
| ***B65D 45/18*** | (2006.01) |
| ***A47L 9/32*** | (2006.01) |
| ***A47L 9/14*** | (2006.01) |

(52) U.S. Cl.

CPC ..... *B65D 45/18* (2013.01); *A47L 9/32* (2013.01); *A47L 9/1409* (2013.01)

(58) Field of Classification Search

CPC ..... B65D 45/18; A47L 9/32; A47L 9/1409; A47L 9/327; A47L 7/0019

See application file for complete search history.

(56) References Cited

U.S. PATENT DOCUMENTS

| | | | |
|---|---|---|---|
| 4,270,668 | A | 6/1981 | Berfield |
| 4,501,378 | A | 2/1985 | Berfield |
| 6,321,410 | B1 | 11/2001 | Holsten |
| D454,672 | S | 3/2002 | Griffin |
| D666,369 | S | 8/2012 | Williams et al. |
| 2010/0199454 | A1 | 8/2010 | Pruitt et al. |

*Primary Examiner* — David Redding

(74) *Attorney, Agent, or Firm* — Armstrong Teasdale LLP

(57) ABSTRACT

A vacuum cleaner includes a canister defining a debris chamber, a lid mounted to a top of the canister, a debris inlet defined by one of the canister and the lid, and a lid latch rotatably connected to the canister. The lid latch is rotatable between a first position, in which the lid latch is disengaged from the lid, and a second position, in which the lid latch engages the lid to secure the lid to the canister. A bottom of the lid latch is spaced from an exterior surface of the canister to define a handle opening that allows a user to insert their fingers into the handle opening and grip the bottom of the lid latch.

20 Claims, 9 Drawing Sheets

VACUUM CLEANER INCLUDING COMBINED HANDLE AND LID LATCH SYSTEM AND METHODS OF ASSEMBLING SAME

FIELD

The field of the disclosure relates generally to vacuum cleaners and, more particularly, to vacuum cleaner handles and lid latch systems.

BACKGROUND

Vacuum appliances, in particular vacuum cleaners, typically include handles that facilitate the manual transport of the vacuum cleaners by a user. Such vacuum cleaners, and in particular wet/dry vacuum cleaners, also incorporate latch systems that are used to secure a lid of the vacuum cleaner to a debris collection base or canister. Some vacuum cleaners have handles and latches that negatively impact the ease of use of the vacuum cleaner, as well as the cost of the cleaner, so a better handle and latch design is needed.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a vacuum cleaner includes a canister defining a debris chamber and having a top, a lid mounted to the top of the canister, a debris inlet defined by one of the canister and the lid, and a lid latch rotatably connected to the canister. The lid latch is rotatable between a first position, in which the lid latch is disengaged from the lid, and a second position, in which the lid latch engages the lid to secure the lid to the canister. A bottom of the lid latch is spaced from an exterior surface of the canister to define a handle opening that allows a user to insert their fingers into the handle opening and grip the bottom of the lid latch.

In another aspect, a method of assembling a vacuum cleaner system includes mounting a lid to a top of a canister, rotatably connecting a lid latch to the canister such that a bottom of the lid latch is spaced from an exterior surface of the canister to define a handle opening that allows a user to insert their fingers into the handle opening and grip the bottom of the lid latch, and rotating the lid latch from a first position, in which the lid latch is disengaged from the lid, to a second position in which the lid latch engages the lid to secure the lid to the canister.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
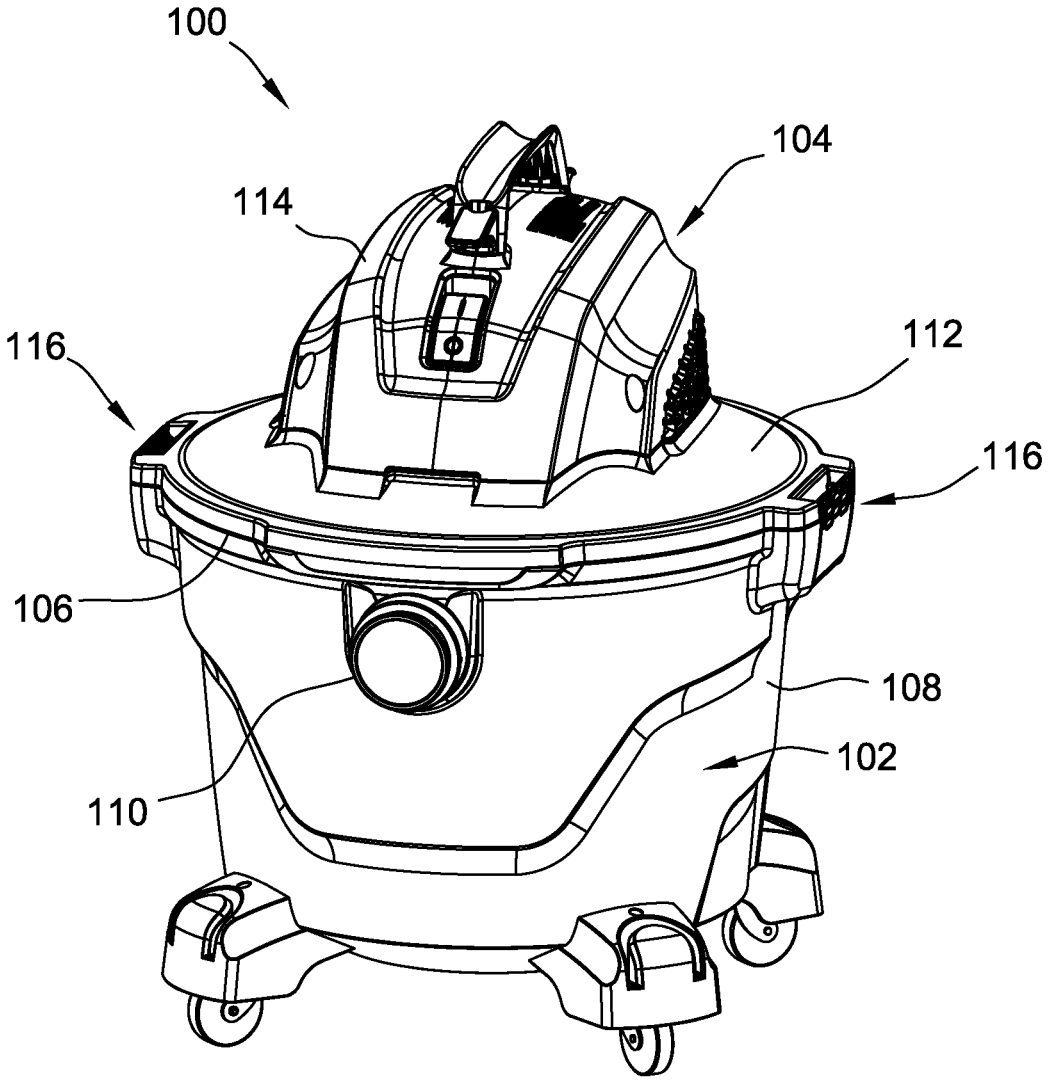
FIG. 1 is a perspective view of an example vacuum cleaner.
Figure 2:
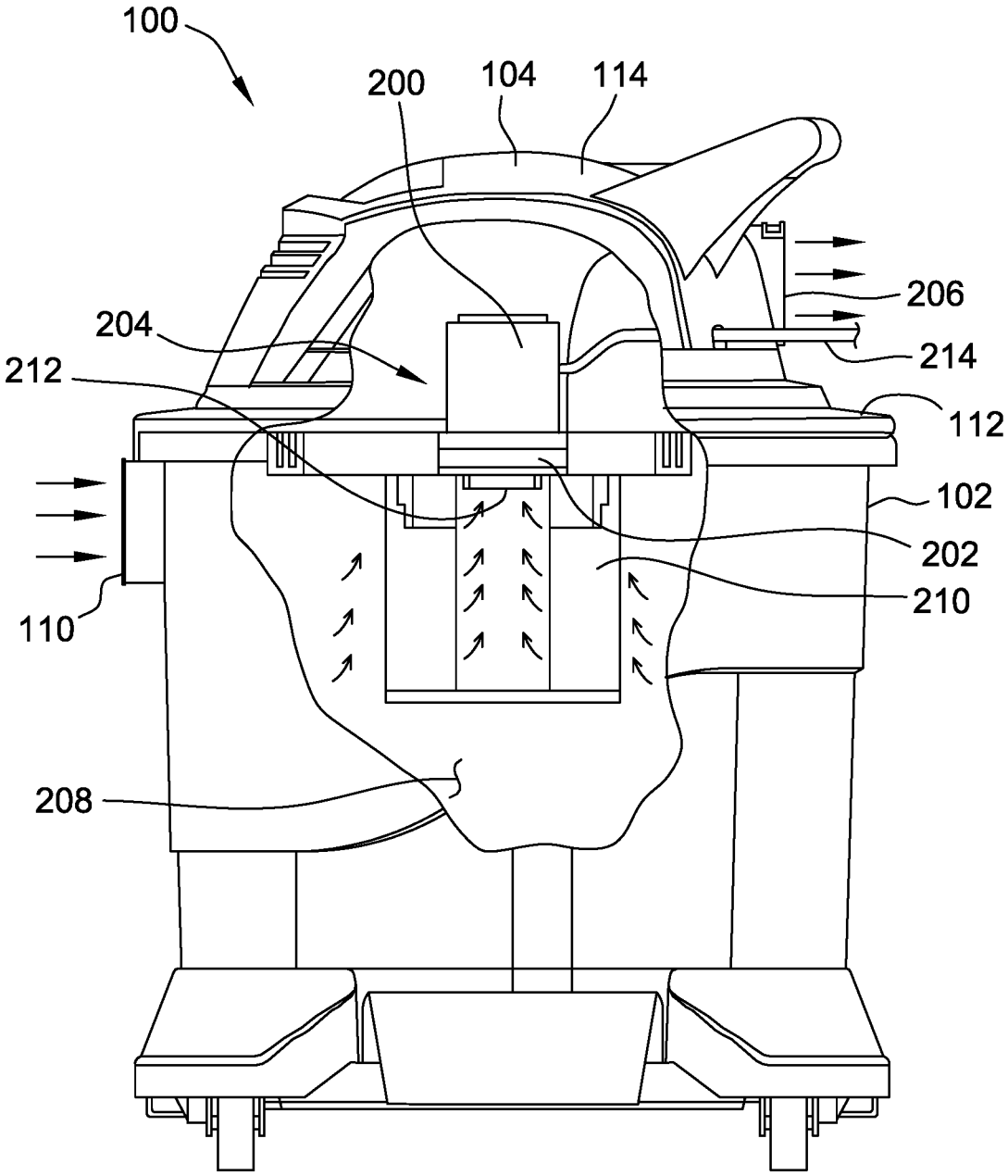
FIG. 2 is a schematic view of the vacuum cleaner shown in FIG. 1.

With reference to the drawings, and in particular FIGS. 1 and 2, an example vacuum cleaner is indicated generally at 100. In the illustrated embodiment, the vacuum cleaner 100 is a wet/dry vacuum cleaner including a collection drum or canister 102 and a powerhead 104 mounted to a top 106 of the canister 102. The canister 102 includes a sidewall 108 and defines a debris chamber 208 enclosed by the sidewall 108. Further, in the illustrated embodiment, the canister 102 defines an inlet 110.

The powerhead 104 includes a lid portion 112 (generally, a lid) and a housing 114 that encloses operational components of the powerhead 104 (e.g., a motor and impeller). The lid 112 is removably attached to the canister 102 so that the lid 112 can be readily removed so as to empty debris or liquids contained within the canister 102. In the illustrated embodiment, the lid 112 is formed integrally as one piece of material with the powerhead housing 114, for example, by a suitable injection molding technique. In other embodiments, the lid 112 may be formed separately from the powerhead 104 and configured to receive the powerhead 104. In such embodiments, the powerhead 104 may be removably connected to the lid 112, and function as a blower when detached from the lid 112.

The powerhead 104 also includes a motor 200 and a fan or impeller 202 connected to the motor 200 (collectively referred to as an impeller assembly 204). As shown in FIG. 2, the motor 200 and impeller 202 are enclosed within the housing 114. The impeller assembly 204 is operable to generate airflow through the canister 102 from the debris inlet 110 to an outlet 206. The impeller assembly 204 is operable to draw solid debris, liquid, or both into the debris chamber 208 defined by the canister 102. In the example embodiment, the inlet 110 is defined by the canister 102, and the outlet 206 is defined by the powerhead 104. In other embodiments, the inlet 110 and the outlet 206 may be defined by any suitable portion of the vacuum cleaner 100 that enables the vacuum cleaner 100 to function as described herein. In some embodiments, for example, the inlet 110 may be defined by the lid 112.

In the illustrated embodiment, the vacuum cleaner 100 further includes a filter assembly 210 connected to, and depending downward from, the powerhead 104 and into the debris chamber 208 to filter debris. In operation, when the motor 200 is energized, air flows into the canister 102 through the vacuum inlet 110, through the filter assembly 210, and into the powerhead 104 through an air inlet 212, before being exhausted back into an environment surrounding the vacuum cleaner 100 through the outlet 206. This vacuum air flow pattern is illustrated generally by the arrows in FIG. 2. In the illustrated embodiment, the motor 200 is connectable to a power source by means of a power cord 214.

The vacuum cleaner 100 also includes a lid latch 116 rotatably connected to the canister 102. In the illustrated embodiment, the vacuum cleaner 100 includes two lid latches 116 rotatably connected to the canister 102, and positioned on diametrically opposite sides of the canister 102. Other embodiments may include any suitable number of lid latches 116 that enable the vacuum cleaner to function as described herein.

The lid latch 116 is rotatable between a first, unlatched position, in which the lid latch 116 is disengaged from the lid 112, and a second, latched position, in which the lid latch 116 engages the lid 112 to secure the lid 112 to the canister 102. As described in more detail herein, a bottom of the lid latch 116 is spaced from an exterior surface of the canister 102 to define a handle opening that allows a user to insert their fingers into the handle opening and grip the bottom of the lid latch 116. The lid latch 116 thereby functions as both a latch to secure the lid 112 to the canister 102, and as a carrying handle that allows the entire vacuum cleaner 100, including the canister 102, the powerhead 104, and the lid 112, to be picked up and transported. As compared to prior designs, the design of lid latch 116 and associated components of the canister 102 simplify handling and carrying of the vacuum cleaner 100 by allowing a user to secure the lid 112 to the canister 102, and pick up the vacuum cleaner 100 in a single step by engaging the same component (i.e., the lid latch 116).

Figure 3:
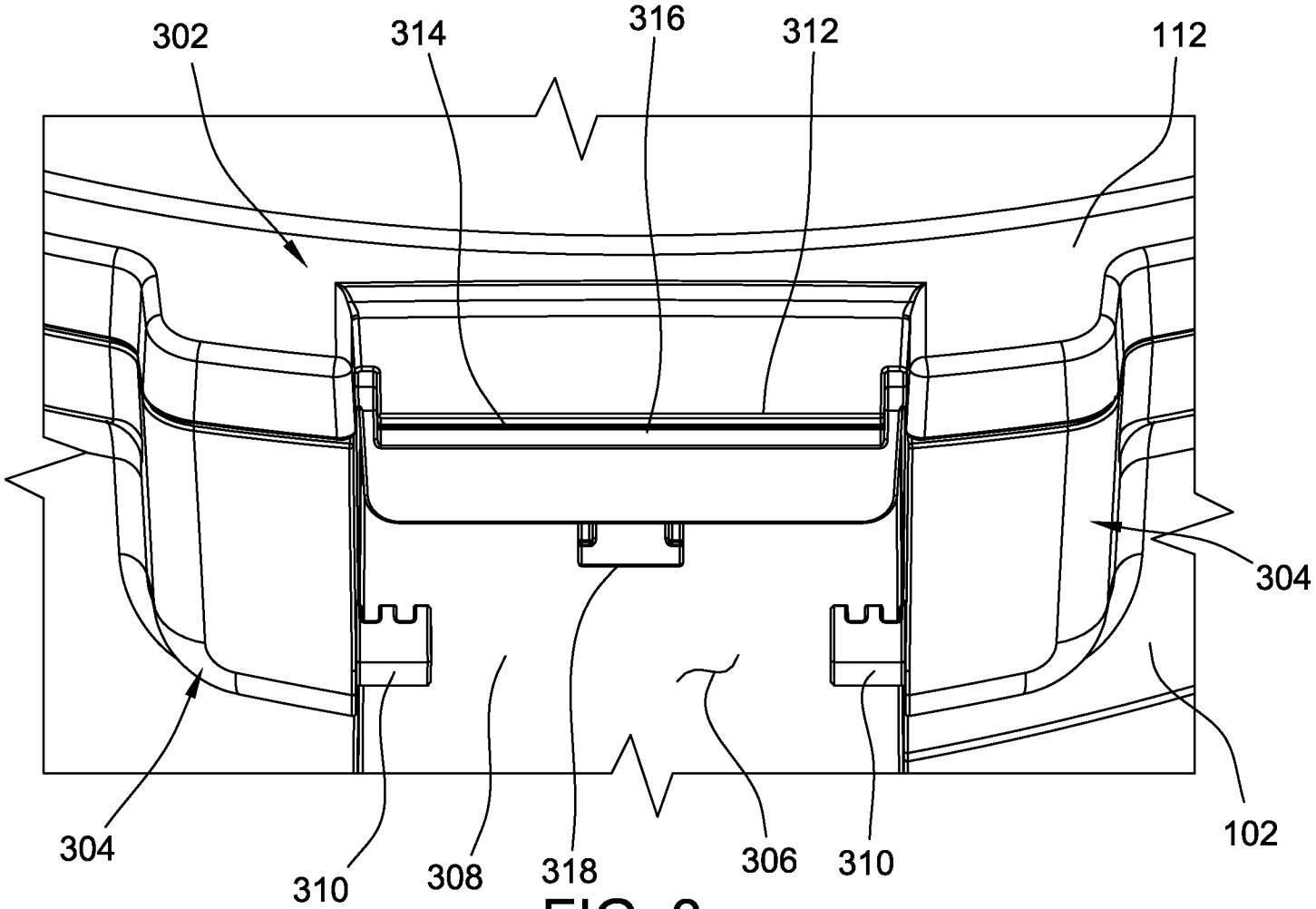
FIG. 3 is an enlarged view of the vacuum cleaner shown in FIG. 1, showing a latch receiving portion of the vacuum cleaner.

FIG. 3 is an enlarged view of the vacuum cleaner 100, showing details of a latch receiving portion 302 of the canister 102. The lid latch 116 is omitted in FIG. 3 to illustrate underlying features. As shown in FIG. 3, the latch receiving portion 302 includes two latch mounts 304 spaced laterally apart from one another to define a latch receiving recess 306 between the latch mounts 304. The latch mounts 304 extend radially outward from an exterior surface 308 of the canister 102, and include posts 310 that extend into the latch receiving recess 306. In the illustrated embodiment, each latch mount 304 includes one post 310. The lid latch 116 is rotatably connected to each of the latch mount posts 310, such that the lid latch 116 rotates about the two posts 310. In other embodiments, the lid latch 116 may be rotatably connected to the canister 102 by only one post, or more than two posts.

In the illustrated embodiment, the latch mounts 304 are integrally formed with the canister 102. In other embodiments, the latch mounts 304 may be formed separately from the canister 102, and connected to the canister 102, for example, by a press-fit connection, screws, pins, or other suitable fasteners (see, e.g., FIG. 9). In such embodiments, the latch mounts 304 may be formed from one, single, integral piece of material such that only one piece needs to be connected to the canister 102 to connect both latch mounts 304 to the canister.

As shown in FIG. 3, the lid 112 includes a latch seat 312 having an upper surface 314 that engages a portion of the lid latch 116 when the lid latch 116 is in the latched position. The latch seat 312 includes a tooth 316 protruding vertically upward from the upper surface 314, and configured to inhibit rotation of the lid latch 116 from the latched position to the unlatched position.

In the illustrated embodiment, the canister 102 also includes a stop tab 318 spaced from the exterior surface 308 of the canister 102. In some embodiments, the stop tab 318 is formed integrally as one piece of material with the canister sidewall 108. In other embodiments, the stop tab 318 may be formed as a separate piece (e.g., an integral piece or molding including the latch mounts 304, see FIG. 9), and connected to the canister 102 for example, by a press-fit connection, screws, pins, or other suitable fasteners. As described further herein, the canister stop tab 318 is configured to cooperatively engage a corresponding stop tab of the lid latch 116 to inhibit over-rotation of the lid latch 116 when the lid latch 116 is rotated from the latched position to the unlatched position.

Figure 4:
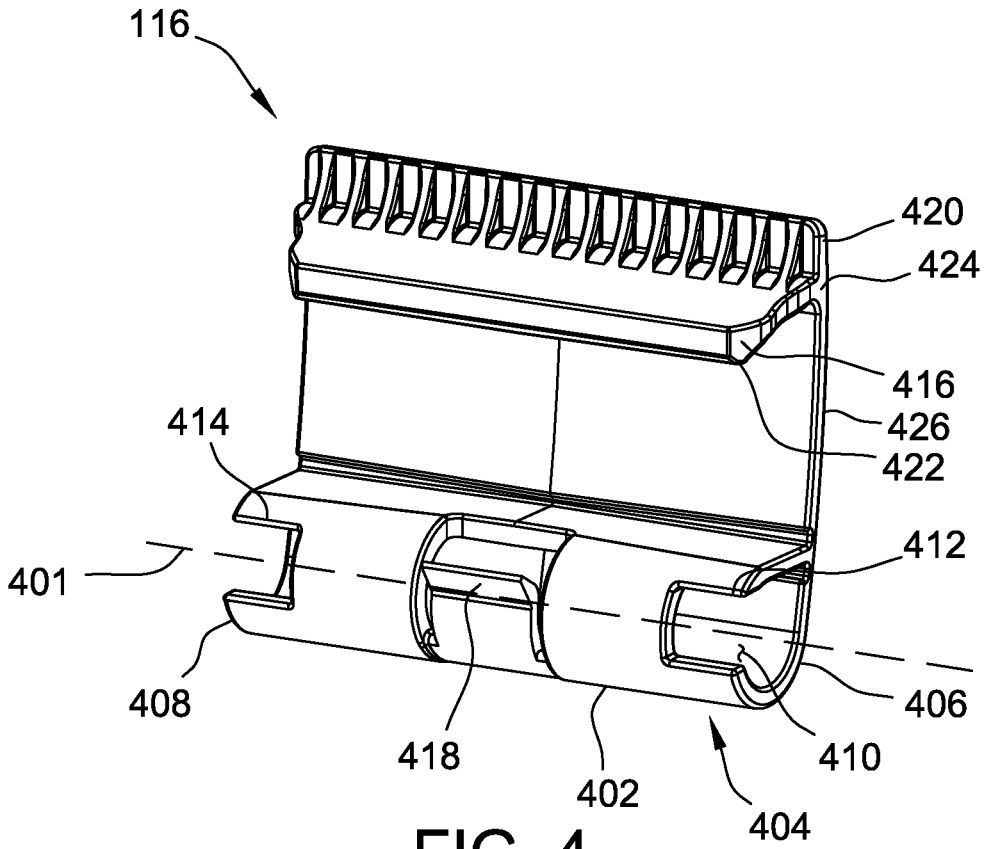
FIG. 4 is a perspective view of a lid latch of the vacuum cleaner shown in FIG. 1.

FIG. 4 is a perspective view of the lid latch 116 shown in FIG. 1. As shown in FIG. 4, a bottom 402 of the lid latch 116 includes a tubular base 404 extending along a rotational axis 401 from a first end 406 of the base 404 to a second end 408 of the base 404. In the illustrated embodiment, the base 404 defines a continuous cavity 410 in which posts, for example the posts 310 of FIG. 3, are positioned when the lid latch 116 is connected to the canister 102. For example, the lid latch 116 is rotatably connected to the canister 102 by a first of posts 310 extending into the cavity 410 from the first end 406 of the base 404, and a second of posts 310 extending into the cavity 410 from the second end 408 of the base 404. In other embodiments, the cavity 410 may be separated into two or more cavities by an internal structure of the tubular base 404.

In the illustrated embodiment, the base 404 further defines a first notch 412 and a second notch 414. The first notch 412 extends into the base 404 from the first end 406 of the base 404, and the second notch 414 extends into the base 404 from the second end 408 of the base 404. Each of the first notch 412 and the second notch 414 is sized and shaped complementary to one of the posts 310 to permit passage of a corresponding post 310 therethrough to connect and disconnect the lid latch 116 from the canister 102. In other embodiments, the base 404 defines fewer or more than two notches extending in the base 404.

In the illustrated embodiment, the lid latch 116 also includes a stop tab 418 configured to cooperatively engage the canister stop tab 318 (FIG. 3) upon rotation of the lid latch 116 from the latched position to the unlatched position to inhibit over-rotation of the lid latch 116 beyond the unlatched position.

As shown in FIG. 4, the lid latch 116 of the illustrated embodiment also includes an arcuate latching portion 416 depending from a top 424 of the lid latch 116. The latching portion 416 is configured to deflect upward from an initial position to a second, deflected position upon engagement with the lid 112 such that the latching portion 416 exerts a downward biasing force against the lid 112 when the lid latch 116 is in the second, latched position. The latching portion 416 includes a latch tooth 422 that engages the latch seat tooth 316 (FIG. 3) to inhibit rotation of the lid latch 116 from the latched position to the unlatched position.

As shown in FIG. 4, the example lid latch 116 further includes a finger tab 420 extending upward from the latching portion 416. When the lid latch 116 is connected to the canister base 102 and in the latched position, the finger tab 420 is spaced from a radial outer surface 502 (FIG. 5) of the lid 112 to enable a user to insert their fingers between the finger tab 420 and the lid 112, and exert an outward force on the finger tab 420 to move the lid latch 116 from the latched position to the unlatched position.

Additionally, in this embodiment, the lid latch 116 includes a curved body 426 extending from the base 404 to the top 424 of the lid latch 116. The curved body 426 is configured to deflect or bend from an initial, curved position, to a second, straightened position when the lid latch 116 is latched to the lid 112 to enable the latch tooth 422 to traverse the latch seat tooth 316.

Figure 5:
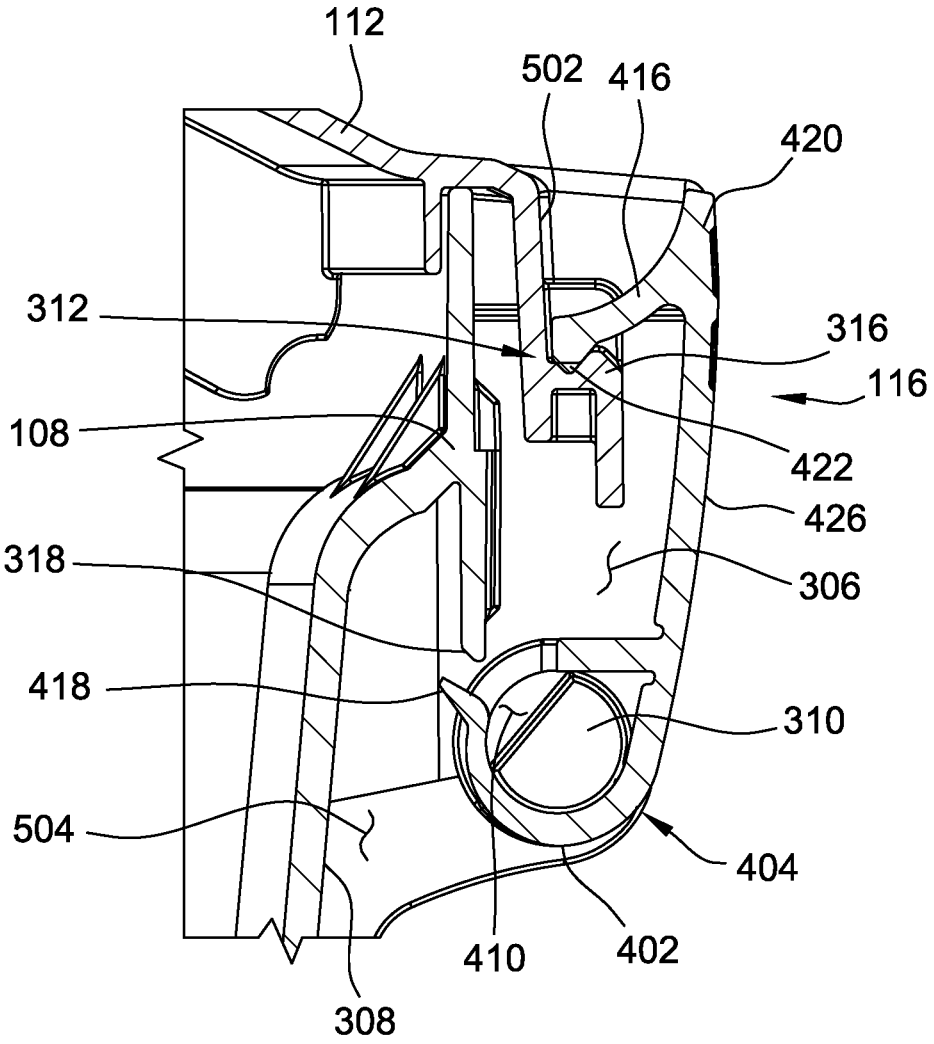
FIG. 5 is a sectional view of a portion of the vacuum cleaner shown in FIG. 1, showing the lid latch in a latched position.
Figure 6:
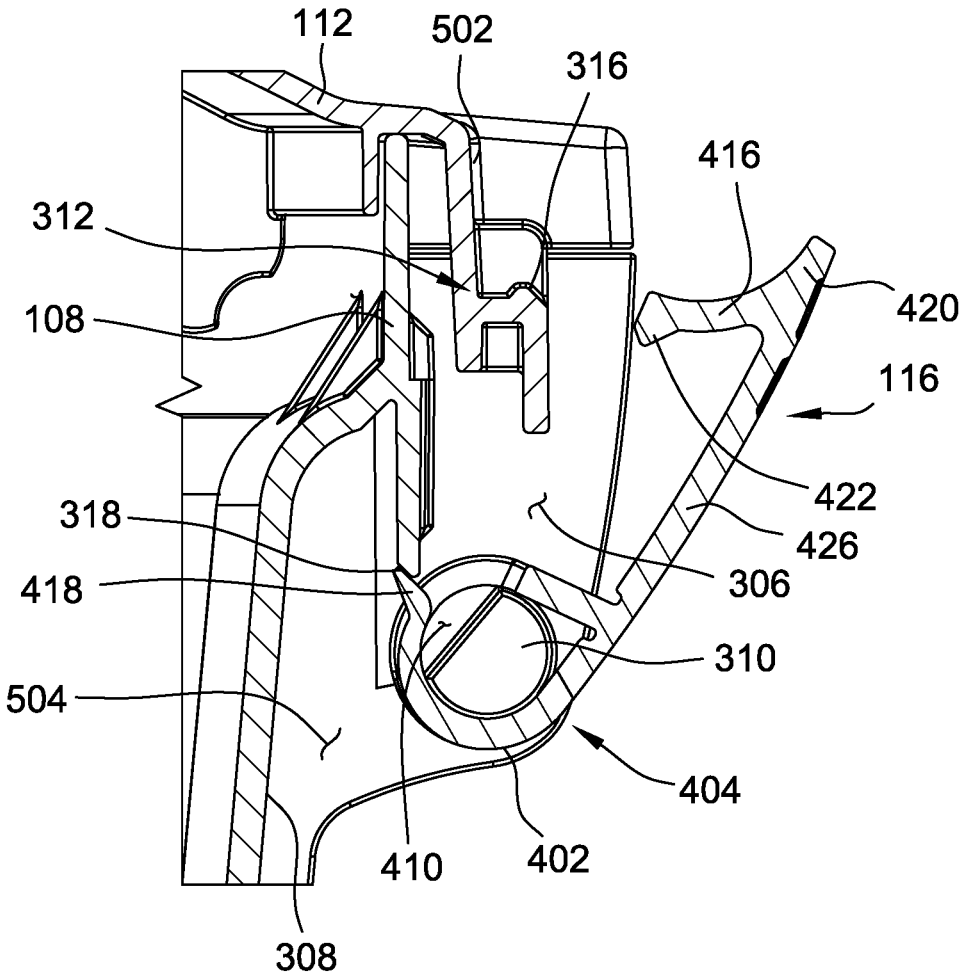
FIG. 6 is another sectional view of the vacuum cleaner shown in FIG. 1, showing the lid latch in an unlatched position.

FIG. 5 is a sectional view of a portion of the vacuum cleaner 100, showing the lid latch 116 in the second, latched position. FIG. 6 is another sectional view of the portion of the vacuum cleaner 100, showing the lid latch 116 in the first, unlatched position. As shown in FIGS. 5 and 6, the bottom 402 of the lid latch is spaced from the exterior surface 308 of the canister 102 to define a handle opening 504 that allows a user to insert their fingers into the handle opening 504 and grip the bottom 402 of the lid latch 116. The lid latch 116 thereby functions as both a latch to secure the lid 112 to the canister 102, and as a carrying handle that allows the entire vacuum cleaner 100 to be picked up and transported. The bottom 402 of the lid latch 116 may also be referred to as a handle portion.

The size of the handle opening 504, or the spacing between the exterior surface 308 of the canister 102 and the bottom 402 of the lid latch 116, may have any suitable size that enables the vacuum cleaner 100 to function as described herein. In some embodiments, for example, the bottom 402 of the lid latch 116 is spaced from the exterior surface 308 by a distance of between 0.5 to 3.0 inches, more suitably between 0.75 inches and 2.5 inches. In the illustrated embodiment, the bottom 402 of the lid latch 116 is spaced 1.0 inches from the exterior surface 308 of the canister 102.

As shown in FIGS. 5 and 6, when the lid latch 116 is connected to the canister 102, the posts 310 (only one shown in FIGS. 5 and 6) is received within the cavity 410 defined by the tubular base 404, thereby rotatably connecting the lid latch 116 to the post 310. Further, when the lid latch 116 is in the latched position, the latching portion 416 (specifically, the latch tooth 422) engages the latch seat 312, causing the latching portion 416 to deflect upwards and exert a downward biasing force against the lid 112. The latch tooth 422 in FIG. 5 is shown as overlapping the latch seat 312 for illustrative purposes to show the amount by which the latching portion 416 would deflect when the lid latch 116 is in the latched position. In practice, the latch tooth 422 would engage and rest on the upper surface of the latch seat 312, causing the latching portion 416 to deflect upwards.

Further, as shown in FIG. 5, when the lid latch 116 is in the latched position, the latch seat tooth 316 engages the latch tooth 422 and inhibits rotation of the lid latch 116 from the latched position to the unlatched position, thereby keeping the lid 112 secured to the canister 102. The latch seat tooth 316 requires a sufficient amount of force to be applied to the lid latch 116 to cause the latching portion 416 to deflect upwards and over the latch seat tooth 316 in order to rotate the lid latch 116 from the latched position to the unlatched position.

As shown in FIG. 6, when the lid latch 116 is rotated from the latched position to the unlatched position, the lid latch stop tab 418 rotates into engagement with the canister stop tab 318, which prevents further rotation of the lid latch 116. The stop tabs 318 and 418 thereby inhibit over-rotation of the lid latch 116, which might otherwise result in the lid latch 116 becoming disconnected from the vacuum cleaner 100 during use.

Figure 7:
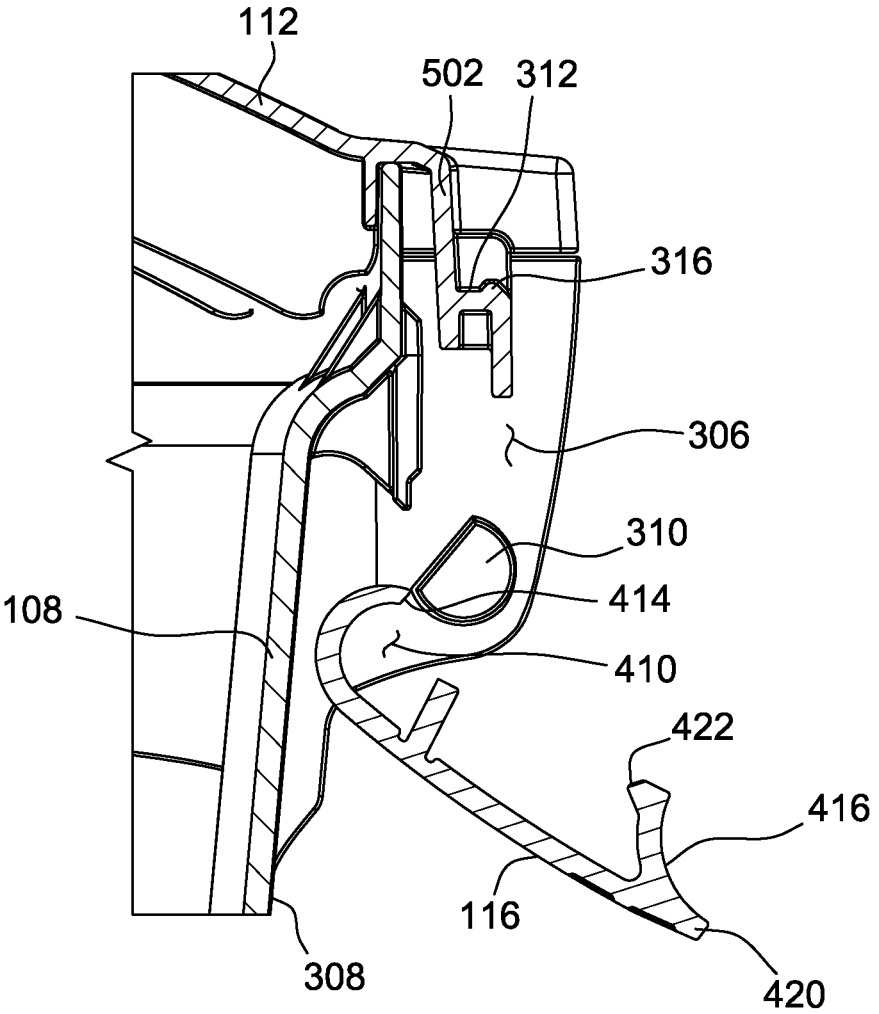
FIG. 7 is a sectional view of the vacuum cleaner shown in FIG. 1, showing the lid latch during a first step of assembly.
Figure 8:
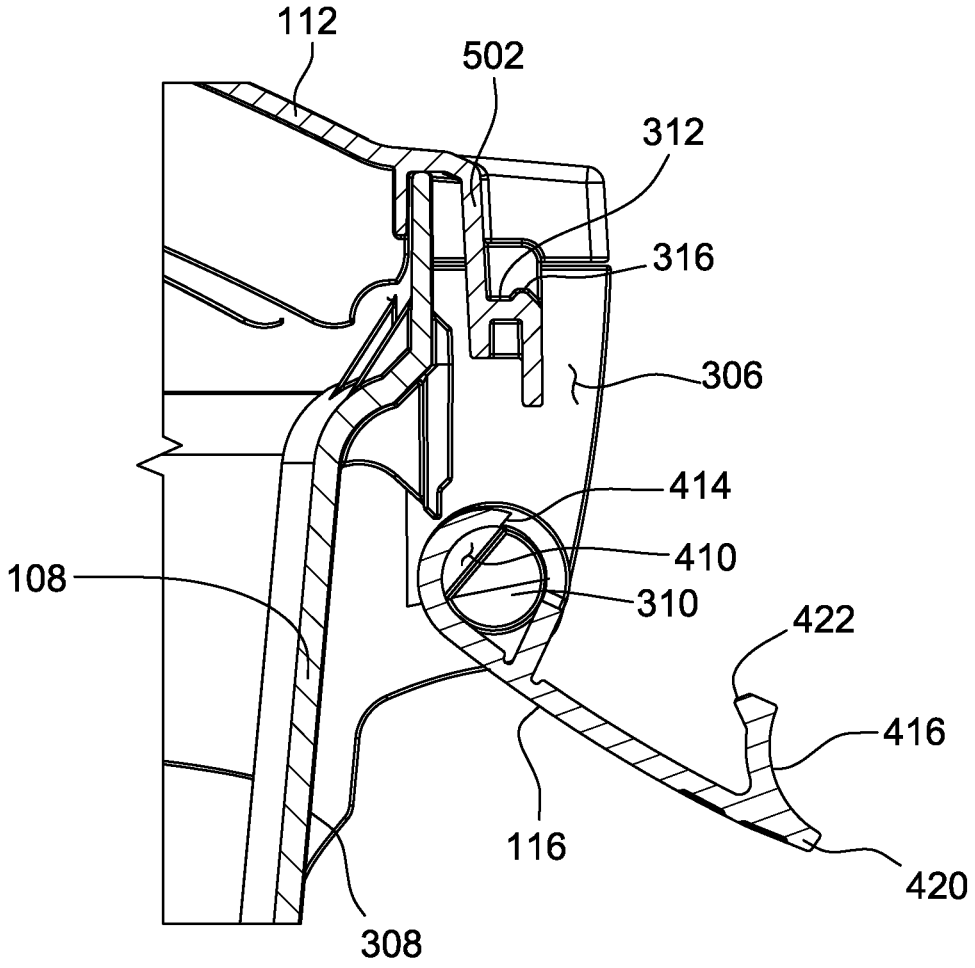
FIG. 8 is another sectional view of the vacuum cleaner shown in FIG. 1, showing the latch during a second step of assembly.

FIG. 7 is a sectional view of the vacuum cleaner 100, showing the lid latch 116 during a first step of assembly. FIG. 8 is another sectional view of the vacuum cleaner 100, showing the lid latch 116 during a second step of assembly.

As shown in FIG. 7, prior to assembly, the lid latch 116 is initially disconnected from the canister 102. During the first step of assembly, the lid latch 116 is positioned in a substantially inverted orientation relative to the latched position, and the lid latch 116 is positioned relative to the posts 310 such that the notches 412 and 414 are aligned with corresponding posts 310.

During the second step of assembly, the lid latch 116 is rotatably connected to the canister 102 by inserting the posts 310 through respective first and second notches 412 and 414 and into the cavity 410 such that the lid latch 116 is rotatable about the posts 310. Once the posts 310 are positioned within the cavity, the lid latch 116 is rotated about the posts 310 from a rotational position beyond the first position, as shown in FIGS. 7 and 8, towards the second position such that the lid latch stop tab 418 engages the canister stop tab 318 (both shown in FIGS. 5 and 6). The lid latch stop tab 418 is configured to deflect inward upon engagement with the canister stop tab 318 during rotation of the lid latch 116 from a rotational position beyond the first position towards the second position such that the lid latch stop tab 418 traverses the canister stop tab 318. In the illustrated embodiment, the lid latch stop tab 418 deflects inward toward the cavity 410 upon engagement with the canister stop tab 318. Continued rotation of the lid latch 116 towards the second, latched position causes the lid latch stop tab 418 to traverse the canister stop tab 318, and deflect back outward away from the tubular base 404 to its original position, as shown in FIGS. 4 and 5.

After the lid latch stop tab 418 traverses the canister stop tab 318, the lid latch 116 is in the first position. The lid latch 116 can be subsequently rotated from the first position, in which the lid latch is disengaged from the lid 112, to the second, latched position to complete assembly of the vacuum cleaner 100.

Figure 9:
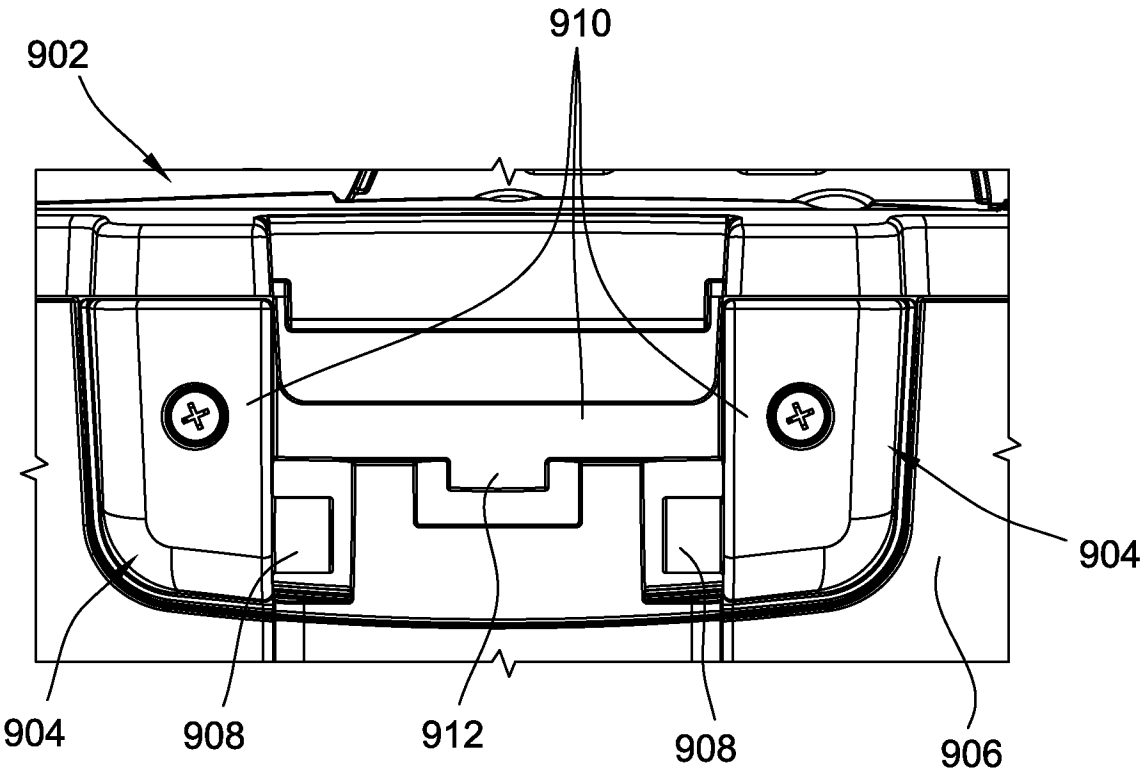
FIG. 9 is an enlarged view of another latch receiving portion suitable for use with the vacuum cleaner shown in FIG. 1.

FIG. 9 is an enlarged view of another latch receiving portion 902 suitable for use with the vacuum cleaner 100. In this embodiment, the latch receiving portion 902 includes latch mounts 904 formed separately from a canister 906. Each latch mount 904 includes a post 908 for connecting a lid latch (e.g., lid latch 116, not shown in FIG. 9) to the canister 906. In this embodiment, the latch mounts 904 are formed together as one, single, integral piece 910, as by a molding process. Additionally, in this embodiment, a stop tab 912 is included on the integral piece 910. The latch mounts 904 and stop tab 912 may be connected to the canister 906 by connecting the integral piece 910 to the canister 906, for example, by a press-fit connection, screws, pins, or other suitable fasteners.

Embodiments of the combined vacuum cleaner handles and lid latches described herein provide improved ease of use as compared to previous vacuum cleaners. For example, embodiments described herein combine the functionality of vacuum cleaner carry handles and lid latches into a single component, thereby enabling a user to interact with the same component to both secure components of the vacuum cleaner together, and carry the vacuum cleaner. Moreover, by combining the carry handles and lid latches into a single component, the vacuum cleaners of the present disclosure reduce the risk of the lid being inadvertently decoupled from the canister when a user carries the vacuum cleaner by the handle portion of the lid latch. Moreover, embodiments of the lid latches described herein are arranged such that the latches are in intimate contact with a user's hands when the vacuum cleaner is transported, thereby enabling the user to quickly and easily transition between lifting or carrying the vacuum cleaner, and latching or unlatching the lid from the canister.

Example embodiments of vacuum cleaners are described above in detail. Aspects of the vacuum cleaners are not limited to the specific embodiments described herein, but rather, components of the vacuum cleaners may be used independently and separately from other components described herein. For example, the handle and lid latch described herein may be used with a variety of vacuum cleaning assemblies and systems, including and without limitation, vehicular vacuum cleaning systems, wet/dry vacuum cleaners, canister vacuum cleaners, upright vacuum cleaners, and backpack vacuum cleaners.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing [s] shall be interpreted as illustrative and not in a limiting sense.

What is claimed is:

1. A vacuum cleaner comprising:

a canister defining a debris chamber and having a top;

a lid mounted to the top of the canister;

a debris inlet defined by one of the canister and the lid; and a lid latch rotatably connected to the canister, the lid latch rotatable between a first position, in which the lid latch is disengaged from the lid, and a second position, in which the lid latch engages the lid to secure the lid to the canister;

wherein a bottom of the lid latch is spaced from an exterior surface of the canister to define a handle opening that allows a user to insert their fingers into the handle opening and grip the bottom of the lid latch.

2. The vacuum cleaner of claim 1, wherein the canister includes at least one post, the lid latch rotatably connected to the at least one post such that the lid latch rotates about the at least one post.

3. The vacuum cleaner of claim 2, wherein the bottom of the lid latch includes a tubular base extending along a rotational axis from a first end to a second end, the base defining at least one cavity in which the at least one post is positioned, wherein the base further defines at least one notch extending into the base from one of the first end and the second end, the notch sized and shaped to permit passage of the at least one post therethrough to connect and disconnect the lid latch from the canister.

4. The vacuum cleaner of claim 3, wherein the at least one post includes a first post and a second post, the first post extending into the at least one cavity from the first end of the base and the second post extending into the at least one cavity from the second end of the base.

5. The vacuum cleaner of claim 1, wherein the canister includes a latch receiving portion including two latch mounts spaced laterally apart from one another to define a latch receiving recess therebetween, each of the latch mounts extending radially outward from the exterior surface of the canister and including a post extending into the latch receiving recess, wherein the lid latch is rotatably connected to each of the latch mount posts.

6. The vacuum cleaner of claim 5, wherein the latch mounts are integrally formed as one piece with the canister.

7. The vacuum cleaner of claim 5, wherein the latch mounts are formed separately from and connected to the canister.

8. The vacuum cleaner of claim 1, wherein the lid latch includes an arcuate latching portion depending from a top of the lid latch, wherein the latching portion deflects from an initial position to a second, deflected position upon engagement with the lid such that the latching portion exerts a downward biasing force against the lid when the lid latch is in the second position.

9. The vacuum cleaner of claim 8, wherein the lid includes a latch seat having an upper surface that engages the latching portion when the lid latch is in the second position, wherein the latch seat includes a tooth protruding vertically upward from the upper surface, and wherein the latching portion includes a latch tooth that engages that latch seat tooth to inhibit rotation of the lid latch from the second position to the first position.

10. The vacuum cleaner of claim 8, wherein the top of the lid latch includes a finger tab extending upward from the latching portion, wherein the finger tab is spaced from a radial outer surface of the lid when the lid latch is in the second position.

11. The vacuum cleaner of claim 1, wherein the lid latch includes a stop tab configured to engage a stop tab of the canister upon rotation of the lid latch from the second position to the first position to inhibit rotation of the lid latch beyond the first position.

12. The vacuum cleaner of claim 11, wherein the lid latch stop tab is configured to deflect inward upon engagement with the canister stop tab during rotation of the lid latch from a rotational position beyond the first position towards the second position such that the lid latch stop tab traverses the canister stop tab.

13. The vacuum cleaner of claim 1, wherein the bottom of the lid latch is spaced at least 0.5 inches from the exterior surface of the canister.

14. The vacuum cleaner of claim 1, wherein the lid latch is a first lid latch, the vacuum cleaner further including a second lid latch rotatably connected to the canister at a location diametrically opposite to the first lid latch.

15. The vacuum cleaner of claim 1, further comprising a powerhead connected to the lid, the powerhead including a motor and an impeller connected to the motor, the impeller operable to generate airflow through the canister from the debris inlet to an outlet.

16. The vacuum cleaner of claim 15, wherein the lid is formed integrally as one piece with the powerhead.

17. The vacuum cleaner of claim 15, wherein the powerhead is removably connected to the lid.

18. A method of assembling a vacuum cleaner system including a canister defining a debris chamber, a lid, and a debris inlet defined by one of the canister and the lid, the method comprising:

mounting the lid to a top of the canister;

rotatably connecting a lid latch to the canister such that a bottom of the lid latch is spaced from an exterior surface of the canister to define a handle opening that allows a user to insert their fingers into the handle opening and grip the bottom of the lid latch; and rotating the lid latch from a first position, in which the lid latch is disengaged from the lid, to a second position in which the lid latch engages the lid to secure the lid to the canister.

19. The method of claim 18, wherein the canister includes at least one post, and wherein the bottom of the lid latch includes a tubular base extending along a rotational axis from a first end to a second end, the base defining at least one cavity and at least one notch extending into the base from one of the first end and the second end;

wherein rotatably connecting the lid latch to the canister includes inserting the at least one post through the at least one notch and into the at least one cavity such that the lid latch is rotatable about the at least one post.

20. The method of claim 19, wherein the lid latch includes a stop tab, the method further comprising rotating the lid latch towards the second position after inserting the at least one post into the at least one cavity such that the lid latch stop tab engages and traverses a stop tab of the canister, wherein the lid latch stop tab engages the canister stop tab to inhibit subsequent rotation of the lid latch beyond the first position.

* * * * *